US006822542B2

(12) United States Patent
Clark et al.

(10) Patent No.: US 6,822,542 B2
(45) Date of Patent: Nov. 23, 2004

(54) SELF-ADJUSTED SUBMINIATURE COAXIAL CONNECTOR

(75) Inventors: Gavin Clark, Tavares, FL (US); Eugene Fischer, Clermont, FL (US)

(73) Assignee: Xytrans, Inc., Orlando, FL (US)

( * ) Notice: Subject to any disclaimer, the term of this patent is extended or adjusted under 35 U.S.C. 154(b) by 0 days.

(21) Appl. No.: 10/200,517

(22) Filed: Jul. 22, 2002

(65) Prior Publication Data

US 2003/0020571 A1 Jan. 30, 2003

Related U.S. Application Data

(60) Provisional application No. 60/307,952, filed on Jul. 26, 2001.

(51) Int. Cl.[7] ..... H01P 1/00; H01P 5/00

(52) U.S. Cl. ..... 333/260; 333/33; 439/63; 439/577; 439/578; 439/581

(58) Field of Search ..... 333/33, 260; 439/63, 439/577, 578, 581

(56) References Cited

U.S. PATENT DOCUMENTS

| | | | | | |
|---|---|---|---|---|---|
| 4,672,342 | A | * | 6/1987 | Gartzke | 333/260 |
| 5,123,863 | A | * | 6/1992 | Frederick et al. | 439/578 |
| 5,146,453 | A | | 9/1992 | Nagler et al. | 370/16 |
| 5,308,250 | A | | 5/1994 | Walz | 439/63 |
| 5,329,262 | A | * | 7/1994 | Fisher, Jr. | 333/33 |
| 5,451,883 | A | | 9/1995 | Staab | 324/758 |
| 5,477,159 | A | | 12/1995 | Hamling | 324/754 |
| 5,552,752 | A | | 9/1996 | Sturdivant et al. | 333/243 |
| 5,619,399 | A | | 4/1997 | Mok | 361/707 |
| 5,631,446 | A | | 5/1997 | Quan | 174/254 |
| 5,823,790 | A | | 10/1998 | Magnuson | 439/53 |
| 5,834,335 | A | | 11/1998 | Buschbom | 438/107 |
| 5,856,768 | A | * | 1/1999 | Hey-Shipton et al. | 333/99 S |
| 5,886,590 | A | | 3/1999 | Quan et al. | 333/33 |
| 5,948,960 | A | | 9/1999 | Langmack et al. | 73/1.88 |
| 5,982,186 | A | | 11/1999 | Buschbom | 324/755 |
| 6,079,999 | A | | 6/2000 | Terry et al. | 439/326 |
| 6,114,869 | A | | 9/2000 | Williams et al. | 324/765 |
| 6,137,296 | A | | 10/2000 | Yoon et al. | 324/754 |
| 6,154,103 | A | * | 11/2000 | Scharen et al. | 333/99 S |
| 6,192,576 | B1 | | 2/2001 | Tan et al. | 29/714 |
| 6,217,382 | B1 | | 4/2001 | Ziers | 439/578 |
| 6,242,933 | B1 | | 6/2001 | Yap | 324/755 |
| 6,252,415 | B1 | | 6/2001 | Lefever et al. | 324/761 |
| 6,288,555 | B1 | | 9/2001 | Harris | 324/637 |
| 6,307,515 | B1 | | 10/2001 | Sauer et al. | 343/702 |
| 6,590,471 | B1 | * | 7/2003 | Scharen et al. | 333/99 S |

FOREIGN PATENT DOCUMENTS

| | | | |
|---|---|---|---|
| EP | 0 901 181 | 9/1998 | H01P/5/08 |

* cited by examiner

*Primary Examiner*—Michael Tokar
*Assistant Examiner*—Khai Nguyen
(74) *Attorney, Agent, or Firm*—Allen, Dyer, Doppelt, Milbrath & Gilchrist, P.A.

(57) ABSTRACT

A subminiature coaxial connector (SMA) includes a shell, dielectric and conductor element that includes a biasing element that engages an interface contact tip and biases the interface contact tip into electrical contact against an electrical circuit, such as a trace on the circuit board without soldering, and adjusts for relative movements created by thermal mismatch.

20 Claims, 2 Drawing Sheets

SELF-ADJUSTED SUBMINIATURE COAXIAL CONNECTOR

RELATED APPLICATION

This application is based upon prior filed copending provisional application Ser. No. 60/307,952 filed Jul. 26, 2001.

FIELD OF THE INVENTION

This invention relates to connectors for coaxial cables and the like, and more particularly, this invention relates to subminiature coaxial connectors (SMA) used for connecting coaxial cable and similar transmission lines at microwave frequencies.

BACKGROUND OF THE INVENTION

Subminiature coaxial connectors (SMA) are commonly used as high performance subminiature connectors at microwave frequencies. These connectors are used by those skilled in the art with coaxial cables, including flexible and semi-rigid cabling. They are useful up to about 18 GHz with semi-rigid cabling, and with flexible cable, the subminiature coaxial connectors can typically be used from DC values to about 12.4 GHz. In other but more rare cases, they can be specified to operate up to about 18 GHz, but could function mode free up to about 25 GHz. Some subminiature coaxial connectors have been designed to operate up to about 27 GHz in even more rare circumstances.

Subminiature coaxial connectors are operable at broadband frequencies and have low reflections. They are typically designed to have a constant 50 ohm impedance and are constantly used by the microwave industry in many applications where an interface must be made from a coaxial line to a trace or other circuit element printed or otherwise positioned on a circuit board.

These standard subminiature coaxial connectors usually have an outer shell and a screw-thread coupling to ensure uniform contact with outer conductors. In some designs, a snap-fit or press-fit connection is used. In any design, tight coupling enables the subminiature coaxial connectors to minimize reflections and attenuations at high frequencies and provide mechanical strength and durability. Reactances are minimal when there is a tight connection, allowing the subminiature coaxial connectors to be used beyond frequencies associated with other types of snap-on subminiature connectors.

Subminiature coaxial connectors are used with microwave active and passive components, high-end radio electronics, instrumentation applications and avionics. Many different types of subminiature coaxial connectors are commercially available, including connectors from companies such as Light Horse Technologies, Inc., Molex, and Johnson Components, as an example. These connectors are available in pressure crimp, clamp and solder terminal attachments, as an example. They provide adequate connections from printed circuit board strip lines, traces, or other similar circuit elements to coaxial cable. Examples of subminiature coaxial connectors and related plugs are found in U.S. Pat. No. 6,217,382 to Ziers and U.S. Pat. No. 5,823,790 to Magnuson.

Many of the more common subminiature coaxial connectors used today require the use of a solder connection to semi-permanently attach the signal line formed as an electrical conductor or trace printed on a circuit board to the central conductor (or connector) of the subminiature coaxial connector. For example, the central conductor or other connector element centrally positioned within the subminiature coaxial connector would extend into a through-hole positioned in the circuit board at the circuit trace and be soldered thereto. Examples of various subminiature coaxial connectors that require solder connections are SMA right angle solder type plugs for semi-rigid cable, straight jacks, straight plugs, and straight bulk head jacks for semi-rigid cable, solder type antenna connector plugs for flexible or semi-rigid cable, and three-piece plug, jack and bulk head jack. Many other types of subminiature coaxial connector plugs use solder connections.

SUMMARY OF THE INVENTION

It is therefore an object of the present invention to provide a subminiature coaxial connector that overcomes the drawbacks of the prior art subminiature coaxial connectors as described above.

It is yet another object of the present invention to provide a subminiature coaxial connector that does not require soldering of the conductor against a circuit board trace or other circuit element and can adjust for relative movements created by thermal mismatch.

The present invention is advantageous and provides a novel and unobvious subminiature coaxial connector and a method of transferring a high frequeny signal in the Gigahertz (GHz) range using the subminiature coaxial connector standard. The present invention allows a low cost and reliable subminiature coaxial connector interface that is aligned normal to the surface of a circuit board and any electrical traces thereon without using a traditional solder processing or through-hole mounts. Thus, the subminiature coaxial connector of the present invention can be attached without subjecting the connector and circuit board to elevated temperatures required for soldering.

The subminiature coaxial connector of the present invention can also be attached to a circuit board without having access to the electrical traces during assembly or processing. The subminiature coaxial connector can be mounted in an inexpensive manner and account for tolerance stack-up, thus allowing a housing (shell) that is less expensive than normal subminiature coaxial connectors because precision machining processes are not required as often required when manufacturing common subminiature coaxial connectors.

The subminiature coaxial connector of the present invention can automatically adjust to relative movements created by thermal mismatch of materials, thus allowing the use of less expensive materials, while decreasing the likelihood of signal degradation because of solder breaks and substrate cracking. It can be used above 3 GHz even when there is a thermal mismatch.

In accordance with the present invention, the connector includes an outer shell. A dielectric is received within the outer shell and includes a longitudinally extending bore. A conductor element is received within the bore and includes an interface contact tip for electrically connecting an electrical circuit, such as a strip line or trace circuit on a circuit board. A biasing element engages the contact tip and biases the interface contact tip into self-adjusting electrical contact against the electrical circuit on the circuit board without soldering. The connector automatically adjusts for relative movement created by thermal mismatch. The outer shell, dielectric and conductor element are preferably formed as a subminiature coaxial connector (SMA). The conductor element further includes a proximal connector opposite the interface contact tip for electrically connecting a coaxial cable using a standard SMA interface connection.

In yet another aspect of the present invention, the biasing element comprises a compliant, spring-loaded intermediate contact. The biasing element can comprise a fuzz button or a pogo pin, in yet another aspect of the present invention. For example, the biasing element could comprise a conductive wool structure, such as a gold plated molybdenum wool that exerts a biasing force, but maintains electrical contact.

In yet another aspect of the present invention, the dielectric and interface contact tip are sized for 50 ohms impedance. The shell can be formed as an SMA shell and be configured for one of a screw-fit, press-fit, or snap-fit connection.

BRIEF DESCRIPTION OF THE DRAWINGS

Other objects, features and advantages of the present invention will become apparent from the detailed description of the invention which follows, when considered in light of the accompanying drawings in which.

DETAILED DESCRIPTION OF THE PREFERRED EMBODIMENTS

Figure 1:
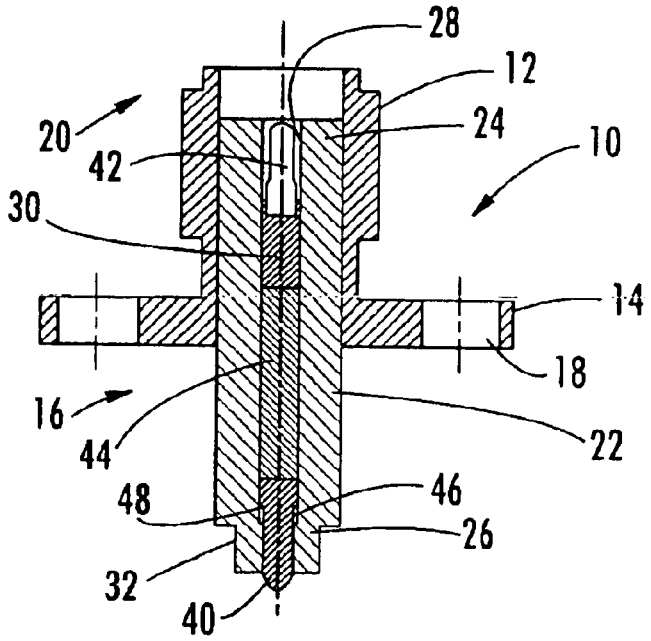
FIG. 1 is a sectional view showing a first embodiment of the subminiature coaxial connector of the present invention and showing basic elements of the shell, dielectric and conductor element.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

The present invention is advantageous and provides a novel and unobvious subminiature coaxial connector allowing the transfer of a high frequeny signal in the Gigahertz (GHz) range using the subminiature coaxial connectors standard. The present invention allows a low cost and reliable subminiature coaxial connector interface that is aligned normal to the surface of a circuit board and any signal lines, such as strip lines or electrical traces thereon, without using traditional solder processing or through-hole mounts. Thus, the subminiature coaxial connector of the present invention can be attached without subjecting the connector and circuit board to the elevated temperatures required for soldering.

The subminiature coaxial connector of the present invention can also be attached to a circuit board without having access to the strip lines or other electrical traces often required during assembly or processing. The subminiature coaxial connector can be mounted in an inexpensive manner and account for tolerance stack-up, thus allowing a housing (shell) that is less expensive than normal subminiature coaxial connectors because precision machining processes are not required, such as when manufacturing more normal subminiature coaxial connectors.

The subminiature coaxial connector of the present invention can automatically adjust to relative movements created by thermal mismatch of materials, thus allowing the use of less expensive materials, which are more prone to a thermal mismatch, while decreasing the likelihood of signal degradation because of solder breaks and substrate cracking. It can be used above 3 GHz even when there is a thermal mismatch among different materials.

FIGS. 1–5 illustrate different embodiments of the subminiature coaxial connector 10 of the present invention that is self-adjusting and overcomes the disadvantages of the prior art as described above. Throughout this description for purposes of clarity, similar structural elements that are common among the different embodiments will be given the same reference numeral in their description.

Figure 3:
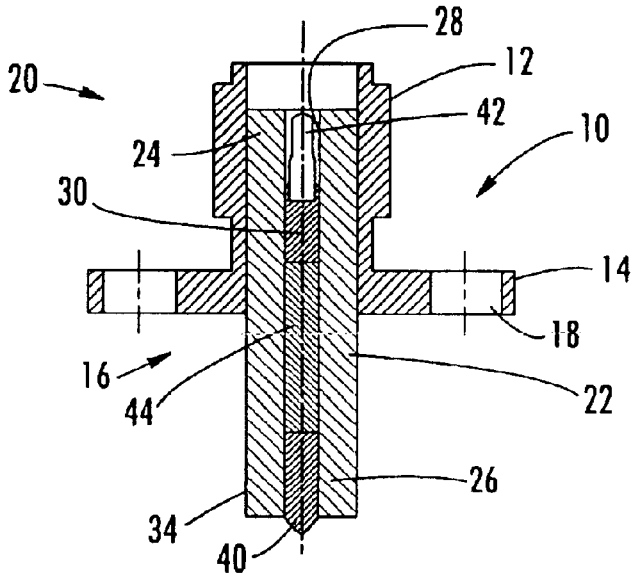
FIG. 3 is a sectional view showing a third embodiment of the subminiature coaxial connector of the present invention similar to the embodiment shown in FIG. 1, but having a different insulator and tip configuration.
Figure 4:
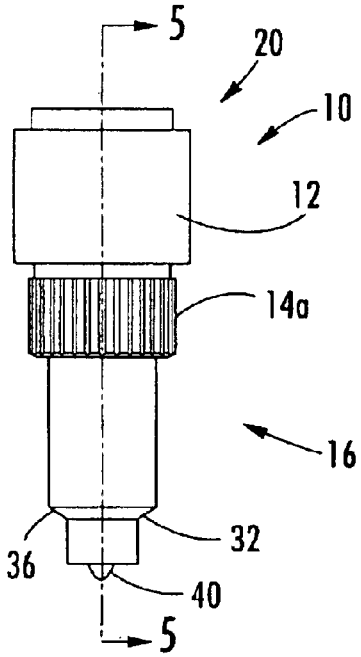
FIG. 4 is an elevation view of a fourth embodiment of the subminiature coaxial connector of the present invention similar to the embodiment shown in FIG. 1, but having a different shell configuration.
Figure 5:
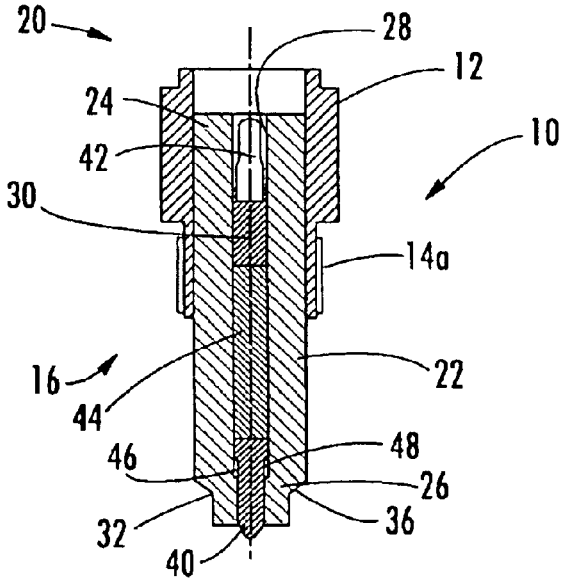
FIG. 5 is a sectional view taken along line 5—5 of FIG. 4.

Referring now to FIG. 1, there is illustrated a subminiature coaxial connector (SMA) 10 of the present invention, and showing an outer shell 12 conventionally formed as an SMA shell. In this particular embodiment shown in FIG. 1, the SMA shell 10 can have screw threads or other appropriate fastener hardware and be formed as a press-fit connection, as known to those skilled in the art. In still other embodiments, the SMA shell 10 can be formed to have a press-fit connection for a tighter and more precise fit. In the particular example shown in FIG. 1, an annular configured support or mounting flange 14 is formed on the lower or distal portion 16 of the SMA shell 12 and includes support orifices or other support structure 18 that can receive any type of connector attachment mechanism for subminiature coaxial connectors, as known to those skilled in the art. The proximal end 20 of the SMA shell 12 is configured to receive the end of a coaxial cable connector, as is standard. The SMA (or outer) shell 12 is typically formed from a metallic, conductive material, as known to those skilled in the art. The embodiments shown in FIGS. 2 and 3 have a similar configured SMA shell using the annular configured support or mounting flange 14, while the embodiments shown in FIGS. 4 and 5 show an embodiment of the SMA shell 12 without an annular configured support or mounting flange 14. Those embodiments instead use a straight, ribbed section 14*a*, as illustrated.

Figure 2:
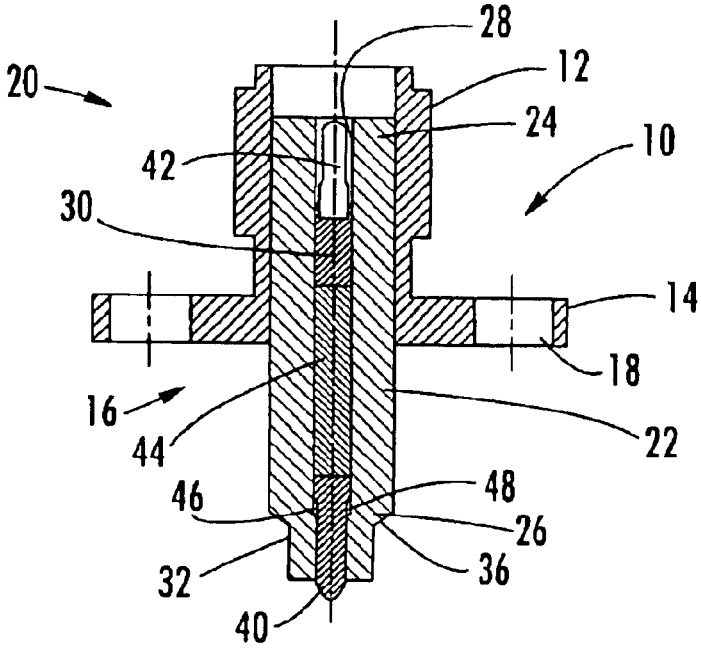
FIG. 2 is a sectional view showing a second embodiment of the subminiature coaxial connector of the present invention similar to the embodiment shown in FIG. 1, but having a different insulator and tip configuration.

A substantially cylindrically configured dielectric 22 acts as a body member and is received within the SMA shell 12. The dielectric 22 has proximal and distal ends 24,26. A longitudinally extending bore 28 extends from the proximal end 24 to the distal end 26 in the illustrated embodiments. The dielectric 22 is formed of a dielectric material having a dielectric capacity that forms a dielectric barrier between the conductive outer shell (SMA shell 12) and a conductor element 30 that is received within the longitudinally extending bore 28 extending from the proximal end 24 to the distal end 26. The conductor element 30 can preferably have a pin-like configuration. The dielectric 22 is sized for 50 ohms impedance and has multiple configurations, as shown in FIGS. 1–5. FIG. 1 shows the dielectric 22 as having an outer stepped shoulder 32 at the distal end 24, while FIG. 3 shows the dielectric formed as having a straight cylindrical section 34 at the distal end without any stepped shoulder. The embodiments of FIGS. 2, 4 and 5 show a stepped configuration, but with a tapered section 36 on the outer stepped shoulder 32. These dielectric configurations can aid in connecting to different types of electrical strip lines or traces on circuit boards or for other connections as suggested to those skilled in the art.

The conductor element 30 is received within the bore 28 and includes an interface contact tip 40 at its distal end for electrically contacting an electrical circuit, such as a circuit trace printed on a circuit board. An SMA proximal connector section 42 is positioned at the proximal end for electrically connecting a coaxial cable in a standard type of SMA connection, and is configured for same.

In accordance with the present invention, a biasing element 44 engages the SMA interface contact tip 40 and SMA proximal connector 42 for completing an electrical path between the SMA interface contact tip 40 and SMA proximal connector 42. The biasing element 44 biases the SMA interface contact tip 40 into electrical contact against an electrical circuit such as a trace printed on the circuit board without requiring a soldering step or through hole assembly. This improved subminiature coaxial connector 10 adjusts for relative movements created by any thermal mismatch, which is often a problem encountered by industry. The dimensions of the dielectric 22, the longitudinally extending bore 28, and the conductor element 30 can be similar to dimensional configurations used in the industry by those skilled in the art.

In accordance with one aspect of the present invention, the biasing element 44 can be formed as a compliant, spring-loaded intermediate contact that is electrically conductive to provide an electrical path from the SMA proximal connector 42 to the SMA interface contact tip. It has been found that the biasing element 44 can be formed as an intermediate contact and include and have a spring mechanism, such as a fuzz button or pogo pin, and/or include an element with two parts and a spring inside. Many different types of fuzz buttons and pogo pins are available. One type of spring element could also include a gold plated molybdenum wool that fills passages through a material to provide conductive pathways. The metallic wool could provide a spring type of mechanism as suggested by those skilled in the art. Examples of fuzz buttons are disclosed in U.S. Pat. Nos. 5,552,752; 5,631,446; 5,146,453; 5,619,399; 5,834,335; 5,886,590; 6,192,576; and 5,982,186. These and any other fuzz buttons can be modified to be operable with the present invention.

A pogo pin can also be used and is a spring-loaded electrical connector adapted to contact and press against a surface. One type of typical pogo pin connector can include wires, pins or cables formed as spring segments or other resilient members. Examples of various types of pogo pins are disclosed in U.S. Pat. Nos. 6,252,415; 6,242,933; 6,137,296; 6,114,869; 6,079,999; 5,451,883, and 5,948,960. These and other types of pogo pins can be modified for use with the present invention.

The dielectric 22 is sized for 50 ohms impedance. The SMA interface contact tip 44 of the present invention is also sized for 50 ohms impedance. Because the contact tip 44 is not soldered to a circuit trace or other electrical contact on the circuit board, the SMA interface contact tip 44 must be configured at its end to engage adequately the circuit trace or other electrical components on a circuit board. The biasing force exerted on the tip 44, however, must still be adequate to maintain electrical contact even when there is relative movement such as created by thermal mismatch. Different types of SMA interface contact tips 40 can be used as shown in FIGS. 1 and 3. In FIG. 3, the longitudinally extending bore 28 includes an internal stepped section 46 at the distal end that receives a stepped shoulder 48 on the SMA interface contact tip 44 to stop extensive longitudinal movement and prevent the tip form falling out of the bore. The embodiment shown in FIG. 3 does not include the stepped configuration, but the biasing element 44 could engage the SMA interface contact tip 44 in a secure manner by an appropriate attachment connection as suggested by those skilled in the art.

Although the embodiments shown in FIGS. 1–5 are only examples of subminiature coaxial connectors in the present invention, other configurations can be suggested by those skilled in the art.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that the modifications and embodiments are intended to be included within the scope of the dependent claims.

That which is claimed is:

1. A subminiature coaxial connector (SMA) comprising:

an SMA shell;

a dielectric received within the SMA shell and having proximal and distal ends and a longitudinally extending bore extending from the proximal to the distal end;

a conductor element slidably received within the bore and comprising an interface contact tip slidably received within the bore at the distal end and configured for electrically contacting an electrical circuit on a circuit board without bonding, a proximal connector slidably received in the bore at the proximal end for electrically connecting a coaxial cable, and a biasing element slidably received within the bore between the interface contact tip and the proximal connector and engaging the interface contact tip and proximal connector for completing an electrical path between the interface contact tip and proximal connector and biasing the interface contact tip into electrical contact against an electrical circuit on the circuit board without bonding when the SMA connector is secured for connection and adjusting for relative movements created by thermal mismatch, wherein said SMA shell, dielectric and conductor element are configured along a longitudinal axis to be normal in orientation to a circuit when engaged and can be readily replaced.

2. A subminiature coaxial connector (SMA) according to claim 1, wherein said biasing element comprises a compliant, spring loaded intermediate contact.

3. A subminiature coaxial connector (SMA) according to claim 1, wherein said biasing element comprises a fuzz button.

4. A subminiature coaxial connector (SMA) according to claim 1, wherein said biasing element comprises pogo pin.

5. A subminiature coaxial connector (SMA) according to claim 1, wherein said biasing element comprises a conductive wool structure.

6. A subminiature coaxial connector (SMA) according to claim 5, wherein said conductive wool structure further comprises a gold plated molybdenum wool.

7. A subminiature coaxial connector (SMA) according to claim 1, wherein said dielectric is sized for 50 ohms impedance.

8. A subminiature coaxial connector (SMA) according to claim 1, wherein said interface contact tip is sized for 50 ohms impedance.

9. A subminiature coaxial connector (SMA) according to claim 1, wherein said SMA shell is configured for a screw-fit or press-fit connection.

10. A connector comprising:

an outer shell;

a dielectric received within the outer shell and having proximal and distal ends and a longitudinally extending bore;

a conductor element slidably received within the bore and comprising an interface contact tip slidably received within the bore at the distal end and configured for electrically contacting an electrical circuit on a circuit board without bonding, a proximal connector slidably received within the bore at the proximal end for electrically connecting a coaxial cable, and a biasing element slidably received within the bore between the interface contact tip and proximal connector and engaging the contact tip for biasing the interface contact tip into self-adjusting electrical contact against an electrical circuit on a circuit board without bonding when the connector is secured for connection and adjusting for relative movements created by thermal mismatch, wherein said SMA shell, dielectric and conductor element are configured along a longitudinal axis to be normal in orientation to a circuit when engaged and can be readily replaced.

11. A connector according to claim 10, wherein said outer shell, dielectric and conductor element are formed as a subminiature coaxial connector (SMA).

12. A connector according to claim 10, wherein said conductor element further comprises a proximal connector opposite the interface contact tip for electrically connecting to a coaxial cable.

13. A connector according to claim 10, wherein said biasing element comprises a compliant, spring loaded intermediate contact.

14. A connector according to claim 10, wherein said biasing element comprises a fuzz button.

15. A connector according to claim 10, wherein said biasing element comprises pogo pin.

16. A connector according to claim 10, wherein said biasing element comprises a conductive wool structure.

17. A connector according to claim 16, wherein said conductive wool structure further comprises a gold plated molybdenum wool.

18. A connector according to claim 10, wherein said dielectric is sized for 50 ohms impedance.

19. A connector according to claim 10, wherein said interface contact tip is sized for 50 ohms impedance.

20. A connector according to claim 10, wherein said shell is configured for one of a screw-fit or press-fit connection.

* * * * *